US005394621A

United States Patent [19]

Levy

[11] Patent Number: 5,394,621

[45] Date of Patent: Mar. 7, 1995

[54] GARMENT DRYER

[76] Inventor: Bernard Levy, 2630 Portola-No. 49, Santa Cruz, Calif. 95062

[21] Appl. No.: 148,399

[22] Filed: Nov. 8, 1993

[51] Int. Cl.[6] ..... F26B 25/00

[52] U.S. Cl. ..... 34/103; 34/437; 34/440; 34/104; 223/69; 223/72

[58] Field of Search ..... 34/21, 103, 104, 105, 34/106, 239, 237, 437, 439, 440; 223/69, 72, 73

[56] References Cited

U.S. PATENT DOCUMENTS

| | | | |
|---|---|---|---|
| 2,016,969 | 10/1935 | McKinney | 223/69 |
| 2,084,854 | 6/1937 | McCarthy | 34/103 |
| 2,506,513 | 5/1950 | Mayer | 223/69 |
| 3,517,865 | 6/1970 | Kannegiesser et al. | 223/69 |
| 3,653,561 | 4/1972 | Shields | 34/103 |
| 4,541,554 | 9/1985 | Endress | 223/66 |
| 4,613,066 | 9/1986 | Saucy | 34/103 |

*Primary Examiner*—Denise L. Gromada

[57] ABSTRACT

A garment dryer having a plurality of segments which are connected together to form the shape of a garment. The garment dryer has a body assembly having two or more body segments to which is connected a pair of extremity assemblies, each of which may be formed in two or more parts. The extremity assemblies may be either arm assemblies or leg assemblies, or both. The arm assemblies may be used with the body assembly to dry garments such as sweaters and sweatshirts. The leg assemblies may be used with the body assembly to dry garments such as pants. The arm and leg assemblies could be used together with the body assembly to dry garments such as jumpsuits. A garment is placed over the assembled garment dryer and is allowed to dry by hanging it either vertically or horizontally. Each of the segments of the garment dryer will nest within one of the other segments so that the entire garment dryer can be compactly stored.

16 Claims, 3 Drawing Sheets

GARMENT DRYER

BACKGROUND OF THE INVENTION

I. Field of the Invention

The present invention generally concerns garment dryers, and more specifically a garment dryer having a plurality of segments which are connected together to form the shape of a garment and allow it to be dried from the inside and the outside, with each of the segments constructed in such a manner that they nest together to form a compact shape for storage.

II. Background of the Invention

The cleaning of sweaters, knitwear and other similar garments has been a long time problem. Washing is the best and cheapest way to clean these products, yet stretching of water heavy garments, very slow drying with accompanying mold and fiber weakening, as well as clumsy, labor intensive, space demanding methods are all problem with current drying techniques. Dry cleaning is expensive, unkind to many fibers and often leaves a chemical residue., The subject invention will prevent stretching and speed up drying, is easy to use, less time and space consuming and will result in a cleaner, fresher, uncontaminated garment.

Typically, drying devices for garments constitute frames or some other structures which support a garment to be dried. These frames or other structures are quite bulky, usually do not assemble and disassemble, and if they do, are usually difficult or time consuming to assemble and disassemble. Additionally, if they do disassemble, they do not nest into a compact shape, thereby taking up much storage space.

Saucy U.S. Pat. No. 4,613,066 discloses a garment drying device which consists of an open mesh torso shape which has sleeves which are connected by Velcro fasteners. The Saucy device does not have rigid parts nor are any of parts or segments shaped in a way as to allow them to nest together to form a compact structure.

McKinney U.S. Pat. No. 2,016,969 discloses an adjustable dryer and stretcher form which includes torso segments and separate sleeve sections which are screwed together. The sections are typically overlapped and joined together by wing nuts and bolts. This form holds the contour of the sweater during drying. There are no means for fastening the segments together without the fasteners projecting into the garment causing impressions. Additionally, the garment does not dry from inside out. Furthermore, there is no easy way to maintain the pieces in a nestable fashion after disassembly.

Additional patents include Mayer U.S. Pat. No. 2,506,513 which discloses a sweater frame for holding a garment in position for drying, Kanageser et al U.S. Pat. No. 3,517,865 which discloses a frame device for shaping knitwear, and Andrews U.S. Pat. No. 4,541,554 which discloses a sock dryer which has telescopic sections. Also, Smith U.S. Pat. No. 3,465,507 discloses a drying board for holding the shape of a sweater during drying.

Among the disadvantages of the prior art is that most of the prior art does not allow the garment to dry from the inside out as well as the outside in. Other disadvantages are that devices are more difficult to use, that the parts of the dryer do not connect easily or, alternatively, are not nestable for easy storage.

SUMMARY OF INVENTION

The present invention fills the need for a convenient, compact garment dryer by providing a plurality of parts which are easily assembled to hold a garment in position so that it can be dried from air moving from the outside in and from the inside out. Additionally, the garment dryer is inexpensive, easy to assemble and disassemble, and easy to store because each of the parts are nestable in the other parts so that the stored device is slightly larger than the largest single part.

The present invention contemplates a garment dryer having a body assembly having two or more body segments to which is connected a pair of extremity assemblies, each of which may be formed in two or more parts. The extremity assemblies may be either arm assemblies or leg assemblies or both. The arm assemblies may be used with the body assembly to dry garments such as sweaters and sweatshirts. The leg assemblies may be used with the body assembly to dry garments such as pants. The arm and leg assemblies could be used together with the body assembly to dry garments such as jumpsuits. After the arm or leg assemblies are connected to the body assembly, a garment is placed over the assembled garment dryer and is allowed to dry by hanging it on a clothes line, shower rod or the like. The garment dryer can be hung vertically or horizontally. The body assembly is separable into two or more basket shaped segments, each of which nests within the largest segment. The extremity assemblies are also separable into two or more segments, each of which is nestable within the largest segment, and that unit then is nested within the body assembly. Consequently, the device is very compact, easy to use, and easy to assemble and disassemble.

DESCRIPTION OF THE PREFERRED EMBODIMENT

Figure 1:
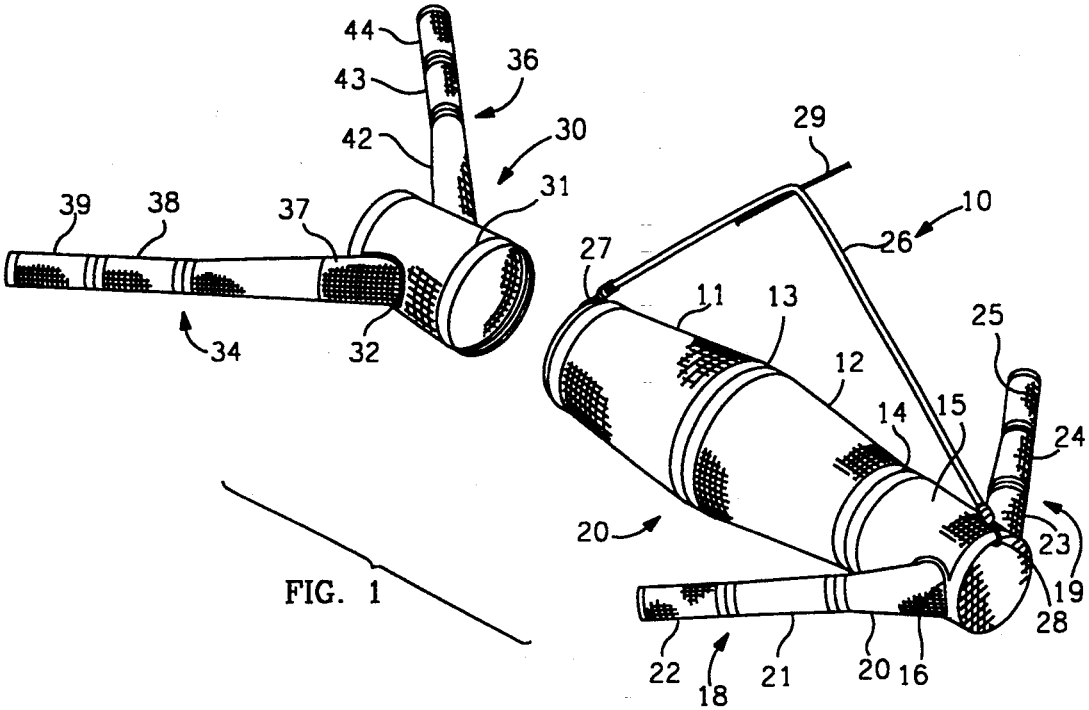
FIG. 1 is a perspective view of the garment dryer which is the subject of this invention showing the garment dryer with the arm assemblies being hung on a clothes line, and also showing the leg assemblies which may be used either separately or in combination for drying different garments.
Figure 2:
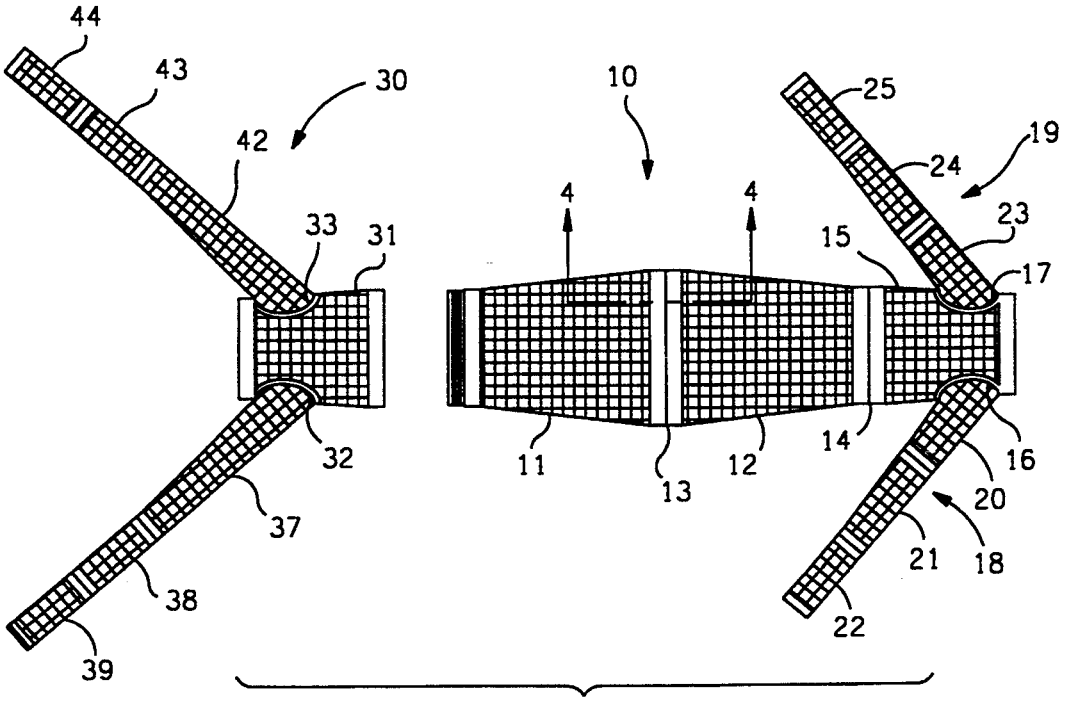
FIG. 2 is a top elevation view of the garment dryer of FIG. 1.
Figure 4:
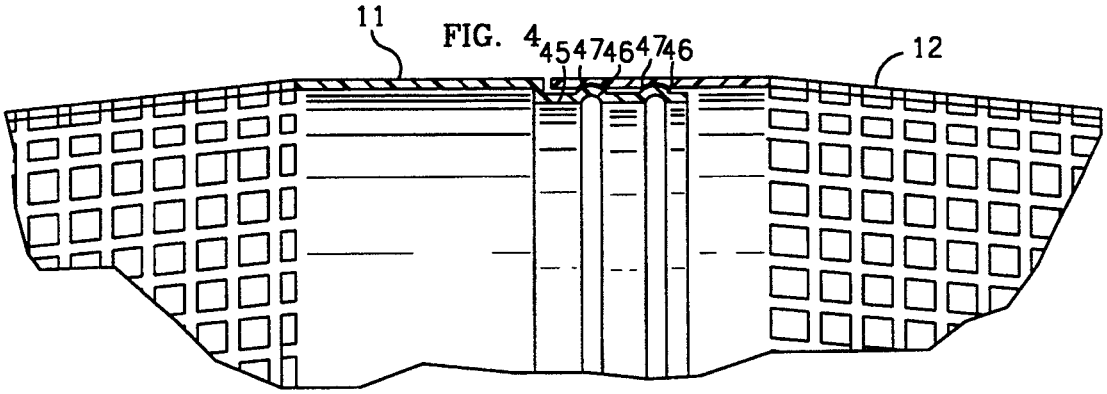
FIG. 4 is an enlarged partial side elevation view of the connection between the first and second body segments.

In accordance with the present invention, FIGS. 1 and 2 show a garment dryer generally designated as 10 having a body assembly 20 comprising a first main body segment 11 which is connected at 13 to a second main body segment 12. The second body segment 12 is connected at 14 to a third end body segment 15. Typically, the connections 13 and 14 will be a threaded connection or by a snap fit (as shown in FIG. 4) or any other means well known in the art. The third segment 15 of the body portion has two apertures 16 and 17 on opposite sides thereof, each for receiving an extremity assembly which in this case is an arm assembly 18 and 19. Each arm assembly could be comprised of one or more segments. As shown in the drawings, one arm assembly 18 comprises segments 20, 21 and 22, each of which is connected to the other by a snap fit, threaded connection or other means well known in the art. The other arm assembly 19 comprises segments 23, 24 and 25. A cord 26 having hooks 27 and 28 at each end could be used to hang the garment dryer onto a clothes line 29 or shower rod. Any other suitable means could be used to hang the garment dryer so that air can flow more freely through the garment. The garment dryer could be hung vertically as well as horizontally if desired.

The garment dryer 10 described above can be used to dry sleeved garments such as sweaters, shirts, jackets and blouses. A similar garment dryer 30 with leg assemblies could also be used to dry pants or other garments with legs. Referring again to FIG. 1, the garment dryer designated as 30 has a body segment 31 which could be connected to additional body segments 11 and 12. The body segment 31 has a pair of apertures 32 and 33 therein for receiving leg assembly 34 and leg assembly 36. The leg assembly 34 has any desired number of parts such as a first leg segment 37, a second leg segment 38, and a third leg segment 39, all of which are interconnected similarly to the arm assemblies 18 and 19 as previously described. The other leg assembly 36 comprises a plurality of segments, such as a first leg segment 42, a second leg segment 43 and a third leg segment 44. After a garment is put onto the garment dryer 30, a cord (not shown) or other hanging means could hang the garment dryer either vertically or horizontally on a clothesline or hook. Alternatively, the garment dryer 30 could be connected to garment dryer 10, and the combination could be used to dry different garments, such as jumpsuits.

Each of the segments of the garment dryer are made of an open mesh structure, typically made of a plastic material. The open mesh holds the shape of the garment and allows the passage of air and facilitates the drying of the garment with air being able to pass from the inside of the dryer form outwardly as well as from the outside in. Thus, a garment can dry much quicker than it if were just placed where the sides of the garment may be in contact with one another if it were lying on a floor or table, or just hanging on a hanger.

Figure 3:
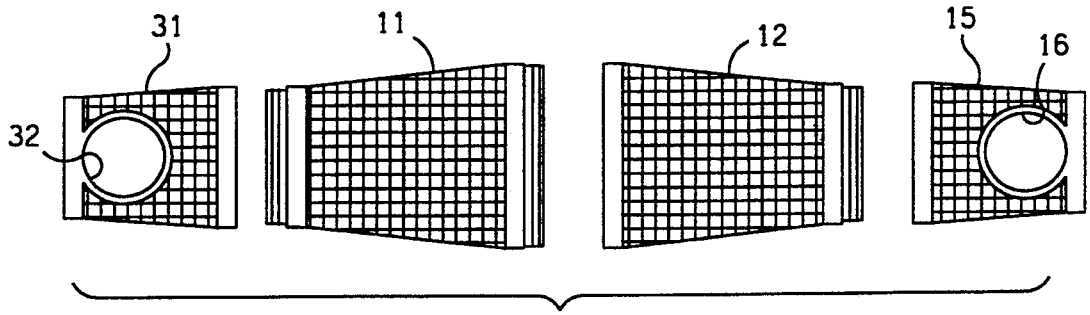
FIG. 3 is a side elevation view of the body assembly of this invention for use with both the arm and leg assemblies with the segments disassembled.

Referring to FIG. 3, there is shown an exploded view of the body segments 11, 12, 15 and 31, further illustrating the threaded connections. If it is desired to extend the length of the garment dryer, an extension which is threaded on both ends could be added between segment 11 and segment 12 or to the end of segment 11. Similarly, segment 31 of garment dryer 30 could be connected to one or more other body segments such as 11 and 12.

The shaped structure of the segments of the subject garment dryer prevents any collapsing of the segments after it is within the garment thereby insuring that air can flow freely through the garment from the outside to the inside and vice versa. By allowing the air to flow more freely within the garment itself as opposed to merely hanging it on a hanger or the like to dry, the drying time is considerably diminished.

Referring to FIG. 4, there is shown an alternative embodiment of the connecting means for connecting the body segments such as 11 and 12. Instead of a threaded connection, one end of the body segment 11 could have a reduced diameter portion 45 which has a plurality of ridges 46 formed therein. The ridges engage a plurality of grooves 47 which are complementary thereto formed in the end of body segment 12. The segments merely snap together instead of being threaded together. A similar connection could also be used between the other body segments, if desired. Other connections or methods of fastening well known in the art could also be used.

Figure 5:
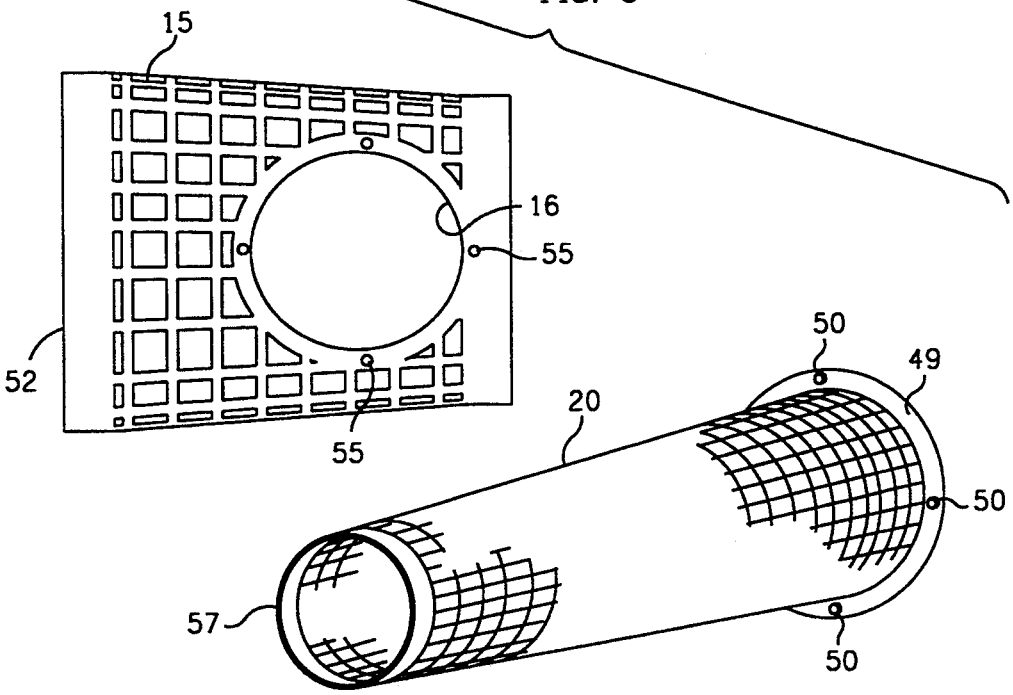
FIG. 5 is a side elevation view of the body segment having a sleeve opening and a perspective view of a sleeve segment.

Referring to FIG. 5, there is shown the end body segment 15 and the arm segment 20. The arm segment 20 has a flange or enlarged end 49 at the large end thereof. The smaller end 51 of the arm segment 20 is inserted into the large opening 52 of the body segment 15 and pushed or pulled through the aperture 16. The arm segment is pulled through until the flange 49 abuts the inside of the body segment 15. A plurality of snaps or projections 50 are provided around the periphery of the flange 49 to snap fit the arm into holes 55 formed in the body segment 15. The leg segments are similar and connect in the same way to end body segment 31

Alternatively, snaps 50 could be positioned on the outside of body segment 15 so that the flange 49 of arm segment 18 could be connected to body segment 15 from the outside. In another alternative embodiment, a Velcro fastener could be used around the flange 49 and the body segment 15 to allow attachment from the outside. Such alternative embodiments permit the entire sleeve assembly to be inserted into the sleeve of the garment before the body segments are inserted, after which the sleeve assemblies can be attached to the body segment. The leg assemblies can be attached in similar fashion.

Figure 6:
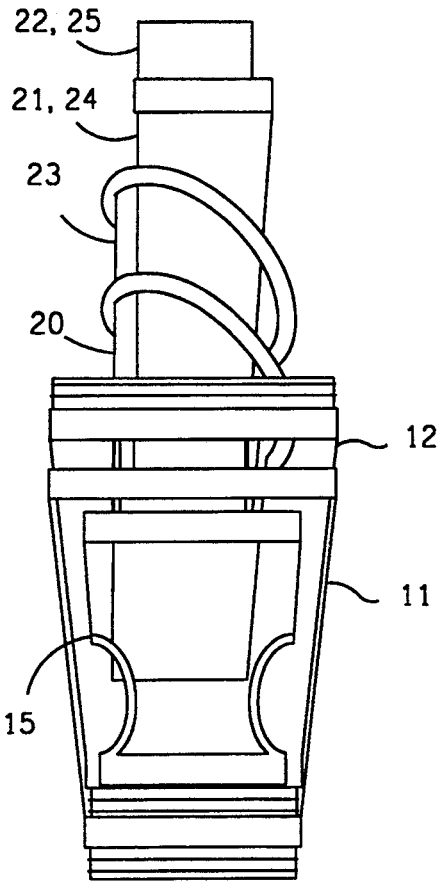
FIG. 6 is a side elevation view of the outlines of the sleeve and body segments illustrating how the sleeve and body segments nest together.

Referring to FIG. 6, the nesting feature of this invention is disclosed. With respect to garment dryer 10, largest portion of the body assembly, body segment 11, has inserted therein the other body segments 12 and 15. Each of the segments 11, 12 and 15 are basket shaped and tapered so that they can be inserted within the other segments. Similarly, the arm segments 20, 21 and 22 and 23, 24 and 25 will nest within one another as shown. This nesting feature allows the garment dryer to be stored after use without taking up a great deal of space.

Figure 7:
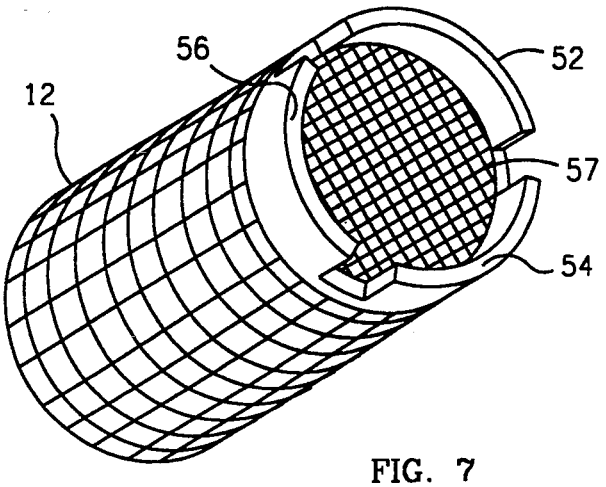
FIG. 7 is a perspective view of one of the body segments of FIG. 1.

Referring to FIG. 7, there is shown body segment 12 illustrating bottom raised portions 53, 54 and 56 upon which the garment dryer can rest, to allow the garment to drip dry as discussed below. The bottom 57 of segment 12 and the bottom of segment 11 is mesh or has openings found therein which allows water to drain therethrough. In addition, the raised portions 53, 54 and 56 around the periphery of the bottom keeps the garment above the drain surface.

Figure 8:
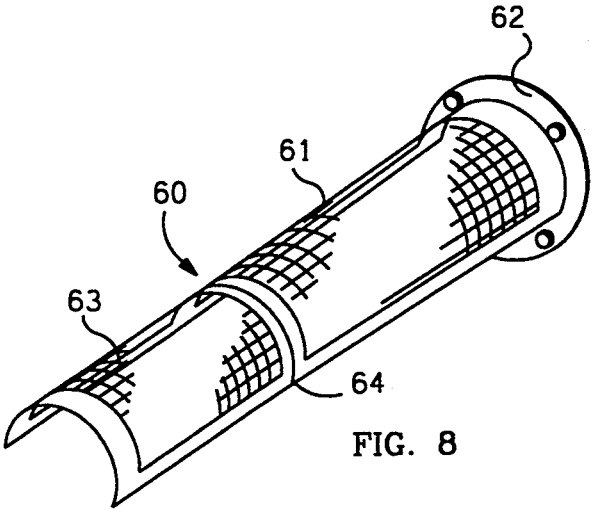
FIG. 8 is an alternative embodiment of a sleeve assembly.
Figure 9:
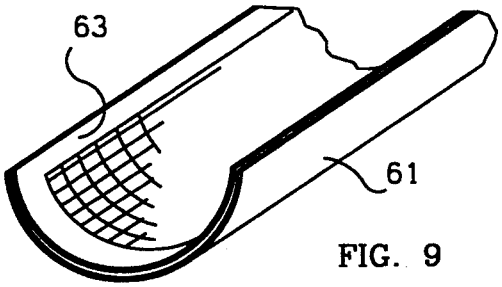
FIG. 9 is a perspective view of a plurality of alternative embodiment sleeve segments from FIG. 8 nested together.

Referring to FIG. 8, there is shown an alternative embodiment of the arm or leg assemblies which have semi-circular cross sections as opposed to circular or oval cross section segments described above. The arm assembly 60 shown in FIG. 8 includes a first arm segment 61 having a flange 62 formed thereon. It is connected at 64 to a second arm segment 63 by snaps or other connection means well known in the art. The use of the half cylindrical cross section elements permits easy nesting of the arm segments as illustrated in FIG. 9. The leg segments could be similarly formed.

In use, after washing and rinsing, the garment is first put into body segment 11 to drain. Gentle squeezing, though not required, will speed draining. After the drip draining has stopped, the garment can be rolled in a towel and gently rung or squeezed. The garment is then put over body segment 15. Sleeve segments 20 and 23 are inserted into one end of body segment 15 and pulled through the openings 16 and 17 respectively and connected to the body segment 15. The sleeve segments 20 and 23 are put into the sleeves of the garment. The sleeves are then rolled up over the respective sleeve segments 20 and 23 to allow the additional arm segments to be attached, after which the sleeves are pulled down over the respective arm assemblies. The body segments 11 and 12 are then attached and the garment is pulled over those body segments. The garment dryer is then hung over a shower rod or clothes line to dry. Alternatively, if an alternative embodiment is used which allows the sleeve segments 20 and 23 to be connected to the body segment 15 from the outside, the procedure is slightly different. In this case, the entire sleeve assembly 18 and 19 can be inserted into each sleeve of the garment. Then the entire body assembly 11, 12 and 15 is put inside the garment and sleeve assemblies 18 and 19 are attached to the body segment 15. At this point, the garment dryer is ready to be hung for drying of the garment. The garment dryer can be used similarly if the extremity assemblies are leg assemblies instead of arm assemblies. The structure of the segments and the open mesh permit relatively rapid drying because of the greater exposure of the inside and the outside of the garment to the air. After the garment is dried the garment is removed from the dryer form and the segments are disassembled, nested together, as shown in FIG. 6, and stored for future use.

Although the present invention has now been described in terms of certain preferred embodiments and exemplified with respect thereto, one skilled in the art will readily appreciate that various modifications, changes, omissions and substitutions may be made without departing from the spirit and scope thereof. It is intended that the present invention be limited solely by the scope of the following claims.

What is claimed is:

1. A garment dryer for drying a garment having a body portion and at least two extremities comprising:

a plurality of body segments connected together to receive and hold the body portion of the garment open so that it can dry from the inside and outside, said segments being nestable within each other;

a first extremity assembly connected to one side of one of said body segments for insertion into one extremity of a garment, said first extremity assembly being nestable within one of said body segments;

a second extremity assembly connected to the opposite side of said body segment connected to said first extremity assembly for insertion into the other extremity of a garment, said second extremity assembly being nestable within said first extremity assembly; and means for hanging said garment dryer.

2. A garment dryer as set forth in claim 1 wherein said first and second extremity assemblies are arm assemblies and wherein each arm assembly comprises a plurality of arm segments connected together, each of which is nestable within the other.

3. A garment dryer as set forth in claim 1, wherein said first and second extremity assemblies are leg assemblies and wherein each leg assembly comprises a plurality of leg segments connected together, each of which is nestable within the other.

4. A garment dryer as set forth in claim 2 for drying a garment having a body portion, sleeves and legs comprising:

an additional body segment connected to said plurality of body segments at the end opposite the body segment connected to said arm assemblies; and a third and fourth extremity assembly connected to opposite sides of said additional body segment for insertion into the legs of a garment.

5. A garment dryer as set forth in claim 1 wherein said body segments have a circular cross section and are connected by complementary screw threads formed in adjacent ends of the connecting segments.

6. A garment dryer as set forth in claim 1 wherein said body segments are connected by a snap fit.

7. A garment dryer as set forth in claim 1 wherein said body segments and said extremity assemblies are made of a mesh material to allow air flow.

8. A garment dryer as set forth in claim 1 wherein said body segments are basket shaped and tapered so that each nests within the other.

9. A garment dryer as set forth in claim 2 wherein the arm assemblies are substantially circular in cross section.

10. A garment dryer as set forth in claim 3 wherein said leg assemblies are substantially circular in cross section.

11. A garment dryer as set forth in claim 2 wherein the arm assemblies are semi-circular in cross section.

12. A garment dryer as set forth in claim 3 wherein the leg assemblies are semi-circular in cross section.

13. A garment dryer as set forth in claim 4 wherein said body segments are basket shaped and tapered so that each nests within the other and said arm and leg assemblies are substantially circular in cross section.

14. A garment dryer for drying a garment having a torso portion and at least two extremities comprising:

A plurality of main body segments connected together and adapted to be inserted into the torso portion of a garment, each body segment being basket shaped and tapered so that one nests within the other;

a pair of extremity assemblies adapted to be inserted into the extremities of a garment;

an end body segment connected to one of the main body segments and having means for connecting each of said extremity assemblies to one side thereof, said end body segment being basket shaped and tapered so that it nests within one of said main body segments; and means for hanging said garment dryer.

15. A garment dryer as set forth in claim 14 wherein each extremity assembly has a plurality of substantially cylindrical segments connected longitudinally with each segment being slightly tapered so that one nests within the other for storage and the nested extremity segments in turn fit within the end body segment.

16. A garment dryer as set forth in claim 14 wherein each of said extremity assemblies comprise a plurality of segments which are substantially semi-circular in cross section.

* * * * *